US006354218B1

(12) United States Patent
Weise et al.

(10) Patent No.: US 6,354,218 B1
(45) Date of Patent: Mar. 12, 2002

(54) PROPELLANT FOR LARGE-CALIBER AMMUNITION

(75) Inventors: Thomas Weise; Hans Karl Haak, both of Unterlüss; Paul Schaffers, Wrestedt; Peter Lange, Waldkraiburg, all of (DE)

(73) Assignees: Rheinmetall W & M GmbH; TZN Forschungs-und Entwicklungszentrum Unterlüss GmbH, both of Unterlüss; Nitrochemie Aschau GmbH, Aschau a. Inn, all of (DE)

( * ) Notice: Subject to any disclaimer, the term of this patent is extended or adjusted under 35 U.S.C. 154(b) by 0 days.

(21) Appl. No.: 09/362,695

(22) Filed: Jul. 29, 1999

(30) Foreign Application Priority Data

Jul. 29, 1998 (DE) ..... 198 34 058

(51) Int. Cl.[7] ..... C06D 5/00; F42B 5/16

(52) U.S. Cl. ..... 102/286; 102/288; 102/289; 102/443

(58) Field of Search ..... 102/286, 289, 102/288, 443, 430

(56) References Cited

U.S. PATENT DOCUMENTS

| | | | | | |
|---|---|---|---|---|---|
| 68,609 | A | * | 9/1867 | Crockett | 102/443 |
| 3,292,545 | A | * | 12/1966 | Matsubara | 102/98 |
| 4,619,202 | A | * | 10/1986 | Romer et al. | 102/443 |
| 5,180,883 | A | * | 1/1993 | Jaskolka et al. | 102/443 |
| 5,287,791 | A | | 2/1994 | Chaboki et al. | 89/8 |
| 5,337,649 | A | * | 8/1994 | Franzen et al. | 89/14.05 |
| 5,341,720 | A | * | 8/1994 | Franzen et al. | 89/45 |
| 5,622,380 | A | * | 4/1997 | Khandhadia et al. | 280/736 |
| 5,998,680 | A | * | 11/1999 | Wier | 280/806 |

FOREIGN PATENT DOCUMENTS

| | | |
|---|---|---|
| DE | 2 055 777 | 3/1972 |
| DE | 34 42 741 | 5/1986 |
| DE | 42 31 259 | 3/1994 |
| EP | 0 338 458 | 10/1989 |
| EP | 0 538 219 | 4/1993 |
| FR | 564685 | 1/1924 |
| FR | 74877 | 1/1961 |
| GB | 801375 | 9/1958 |
| GB | 2 262 154 | 6/1993 |
| GB | 2 284 041 | 5/1995 |

* cited by examiner

*Primary Examiner*—Michael J. Carone
*Assistant Examiner*—Aileen J. Baker
(74) *Attorney, Agent, or Firm*—Venable; Gabor J. Kelemen

(57) ABSTRACT

A propellant system for launching a large-caliber projectile includes a propellant having at least three partial charges. The first partial charge is adapted to acceleration requirements of the projectile; the second partial charge has a higher combustion velocity than that of the first partial charge; and the third partial charge has a lower combustion velocity than that of the first partial charge. The propellant system further includes an electric energy supply and control device connected to the propellant for igniting the propellant. The electric energy supply and control device has a plasma generator for affecting a combustion behavior of the propellant such as to obtain for said first partial charge, after ignition of the propellant, a maximum gas pressure level of always the same magnitude independently from an initial propellant temperature, and to obtain, for the third partial charge, a conversion such as to prolong the maximum gas pressure level in a predeterminable manner.

9 Claims, 3 Drawing Sheets

PROPELLANT FOR LARGE-CALIBER AMMUNITION

CROSS REFERENCE TO RELATED APPLICATION

This application claims the priority of German Application No. 198 34 058.3 filed Jul. 29, 1998, which is incorporated herein by reference.

BACKGROUND OF THE INVENTION

This invention relates to a propellant for accelerating projectiles of large-caliber ammunition and further relates to an electric energy supplying and control device coupled with the propellant for igniting the charge and controlling its combustion process by means of an arc plasma.

An increase of the firing power of known barrel-type weapons is conventionally achieved by propellants whose chemical composition results in an increase of the temperature of the propellant gases upon firing a shot. Higher gas temperatures of the propellant, however, are disadvantageous in that they lead to an excessively high erosion of the weapon barrel. Further, the firing power in known barrel-type weapons depends essentially from the temperature of the propellant powder before the shot is fired.

Conventionally, as disclosed, for example, in European Patent No. 0 538 219, for reducing the temperature-dependent influence of the powder, the propellant is composed of a plurality of partial charges made up of different powder types, charge sizes and geometrical shapes of the powder.

SUMMARY OF THE INVENTION

It is an object of the invention to provide an improved propellant system of the above-outlined type which leads to an increase of the firing power of the barrel-type weapon without the need for a significant temperature increase of the propellant gases generated by chemical reaction (propellant conversion). It is a further object to avoid a temperature-dependent influence on the propellant powder.

These objects and others to become apparent as the specification progresses, are accomplished by the invention, according to which, briefly stated, the propellant system for launching a large-caliber projectile includes a propellant having at least three partial charges. The first partial charge is adapted to the acceleration requirements of the projectile; the second partial charge has a higher combustion velocity than that of the first partial charge; and the third partial charge has a lower combustion velocity than that of the first partial charge. The propellant system further includes an electric energy supply and control device connected to the propellant for igniting the propellant. The electric energy supply and control device has a plasma generator for affecting a combustion behavior of the propellant such as to obtain for said first partial charge, after ignition of the propellant, a maximum gas pressure level of always the same magnitude independently from an initial propellant temperature, and to obtain, for the third partial charge, a conversion such as to prolong the maximum gas pressure level in a predeterminable manner.

The invention is based on the principle that the ignition and a controlled chemical reaction of the propellant with increased energy content is achieved by utilizing electrical energy by means of at least one arc plasma.

According to the invention, the propellant is composed of at least three partial charges having different behaviors of combustion. Thus, the first partial charge is adapted to the acceleration requirements of the projectile mass to be launched and which constitutes the preponderant proportion of the propellant volume. The second partial charge has a higher combustion velocity than the first partial charge and thus leads to a steeper slope of the gas pressure curve of the propellant. The third partial charge has a combustion velocity which is less than that of the first partial charge and which, influenced by the arc plasma, effects a prolongation of the maximum gas pressure level defined by the first partial charge.

DESCRIPTION OF THE PREFERRED EMBODIMENTS

Figure 1:
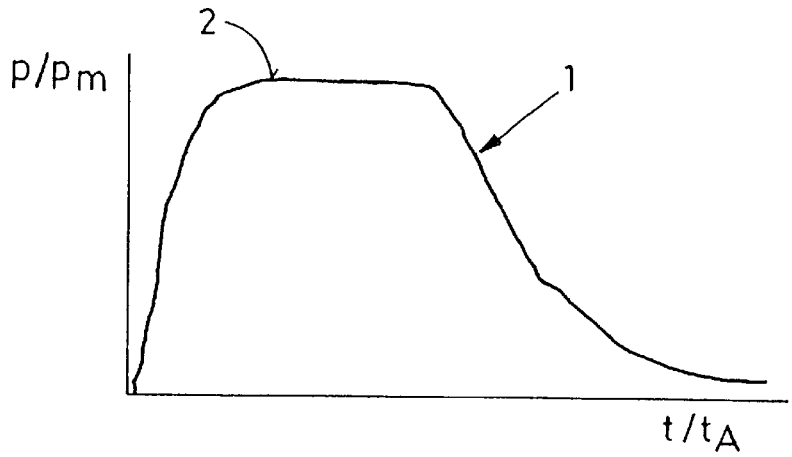
FIG. 1 is a diagram showing a gas pressure curve of a propellant composed of three partial charges according to the invention.

Turning to FIG. 1, the curve generally designated at 1 represents the pressure of a propellant composed of three partial charges according to the invention. The abscissa indicates the time t, related to the time period $t_A$ which is needed for the projectile to reach the barrel muzzle. The ordinate indicates the gas pressure p related to the maximum gas pressure $P_m$, designated as the generally horizontal portion 2 of the curve 1.

As may be observed in FIG. 1, the gas pressure p, after reaching its maximum value 2, is to be maintained for a certain period (typically in the millisecond range) at the maximum value before the pressure drops which is required for obtaining a moderate muzzle gas pressure.

Figure 2:
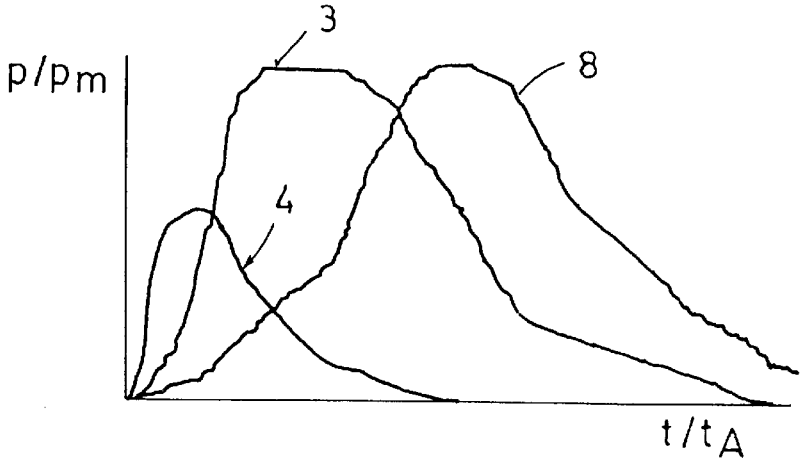
FIG. 2 is a diagram illustrating gas pressure curves of the individual three partial charges of the propellant according to the invention.
Figure 3:
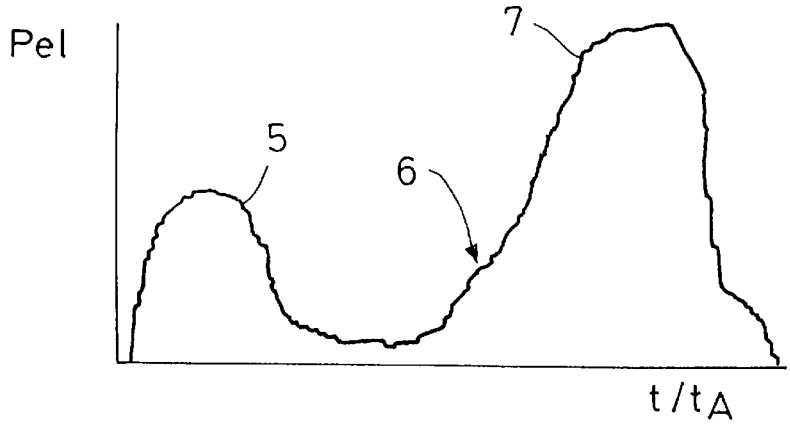
FIG. 3 is a diagram of the electric output as a function of time which has to be applied to the propellant by three arc plasmas to obtain the gas pressure curve illustrated in FIG. 1.

For obtaining the gas pressure course illustrated in FIG. 1, the propellant is composed of three partial charges having different combustion behaviors. The gas pressure course of each partial charge is illustrated in FIG. 2. The first partial charge which is adapted to the acceleration requirements of the projectile mass to be launched has a pressure course designated at 3. The second partial charge which has a higher combustion velocity with respect to the first partial charge 3 and whose course is designated at 4, renders the slope of the gas pressure course 1 (FIG. 1) steeper until the maximum gas pressure 2 is reached. Both partial charges are ignited (initiated) by an electrically generated arc plasma. In this process, by a correspondingly selected shape of a first pulse 5 of the electric output, designated at 6 in FIG. 3, the ignition is effected such that, independently from the initial temperature of the propellant powder, always the same maximum gas pressure 2 (FIG. 1) is reached.

The third partial charge has a combustion velocity which is less than that of the first partial charge. Such reduced combustion velocity is achieved, for example, by a suitable selection of the grain geometry with a digressive or only slightly progressive combustion behavior which necessarily leads to an increase of the powder fill factor of the grains and thus to an increase of the packing density of the third partial charge. With the aid of a suitably selected shape of a second power pulse 7 (FIG. 3) the chemical reaction of the third partial charge is effected so that a gas pressure course designated at 8 in FIG. 2 is obtained which leads to an extension of the maximum pressure level 2 shown FIG. 1.

Figure 4:
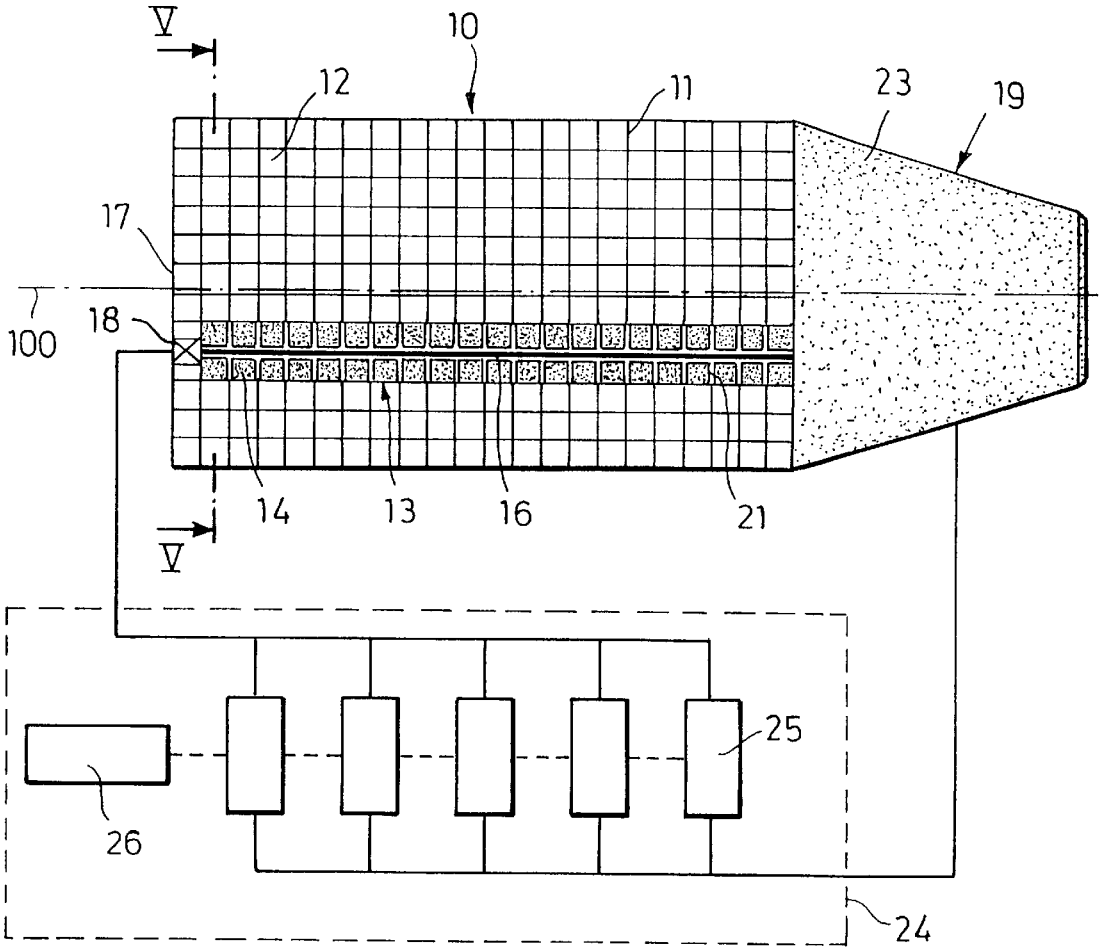
FIG. 4 is a schematic side elevational view of a first preferred embodiment of a propellant according to the invention, also showing a block diagram of the energy supply and control device.
Figure 5:
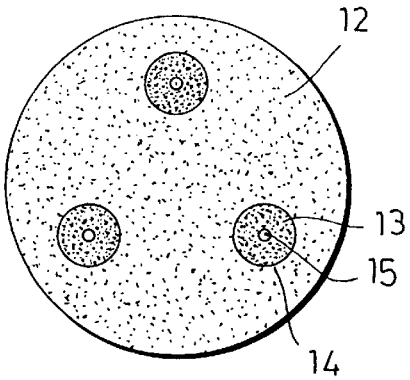
FIG. 5 is a sectional view taken along line V—V of FIG. 4.

FIG. 4 shows a propellant 10 according to a preferred embodiment of the invention. The preponderant part of the volume of the propellant 10 is filled by the first partial charge 11 in such a manner that the highest possible packing density is reached. The first partial charge 11 consists of a stacked construction of hexagonal or rosetta-shaped powder grains 12 in a 7-hole or a 19-hole geometry. The external geometry and wall thickness of the powder grains 12 are adapted to the given acceleration course of the respective projectile.

The third partial charge 13 which is arranged inside the first partial charge 11 is formed of three radially symmetrically disposed tubular powder bars 14 each having a longitudinally extending inner channel 15 accommodating a thin electric wire 16. Each wire 16 is connected with a first electrode 18 located at the bottom 17 of the propellant 10 and a second electrode 20 situated in the frontal conical region 19 of the propellant 10. The second electrode 20 is connectable electrically with the weapon barrel in a manner not illustrated for the sake of clarity.

The diameter of the inner channel 15 of each powder bar 14 is selected such that the electrical boundary conditions for parallel burning arc discharges set themselves rapidly to a stable state. The length of the powder bars 14 and thus the stacked construction are selected as a function of the electric impedances of the arc plasmas and as a rule amounts to a few hundred millimeters. In the powder bars 14 circumferentially uniformly distributed radial holes 21 of small diameter are provided. The second partial charge 23 which is arranged in the frontal conical region 19 of the propellant 10, is composed of rapidly burning bulk powder. The thin wires 16 pass through the partial charge 23.

The propellant 10 is connected electrically with an energy supply and control device 24 shown in block diagram form in FIG. 4. The device 24 is composed of a plurality of energy storing devices 25 which may be discharged in a time sequence determined by a control system 26. The discharging process occurs first via the thin wires 16 passing through the propellant 10 which disposed in the weapon chamber. The wires vaporize explosively and initiate three parallel-burning arc discharges in the powder bars 14 and the bulk powder charge 23.

The adjustment of the combustion behavior of the propellant 10, composed of the combustion behaviors of the partial charges 11, 13 and 23 is effected electrically (by controlling the energy quantity of the individual module of the EVA, the pulse shape and/or the discharge cycles) and is also effected by the composition, as well as the number and shape of the partial charges (geometry of the powder grains, number of the powder bars as well as their inner and outer dimensions, etc.), as previously described.

It is to be understood that the invention is not limited to the above-described embodiment. Thus, for example, more than three tubular powder bars may be used to generate a higher number of arc discharges.

Figure 6:
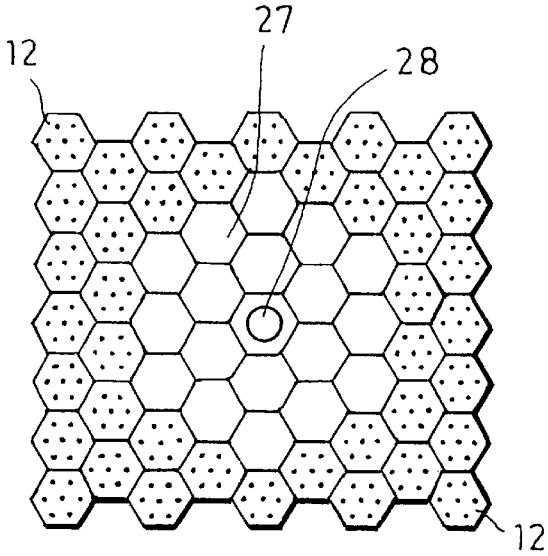
FIGS. 6, 7 and 8 are cross-sectional views, similar to FIG. 5, of three further preferred embodiments of the propellant according to the invention.

Furthermore, the powder bars may be replaced by 0-hole powder grains which are arranged about respective arc channels. A further preferred embodiment is shown in FIG. 6 where the powder grains 12 constitute the first partial charge while the 0-hole powder grains 27 form the third partial charge and surround an arc channel 28.

To obtain a substantial optical transparency for the penetration of the arc radiation, the additional graphite and carbon black particles are omitted from the powder bars 14 and also from the powder grains 27.

For a superior adaptation of the dynamic processes occurring during the chemical reaction, a layer-like transition of the 0-hole grains to the 7 or 19-hole grains in the radial direction is feasible and/or a variation of the individual stacks parallel to the longitudinal axis 100 of the propellant 10 may be effected.

Figure 7:
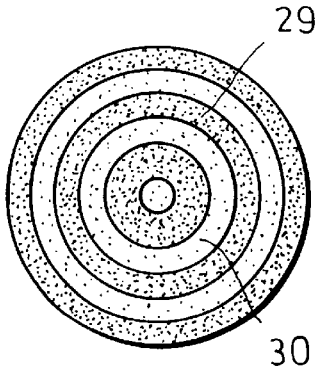
Figure 8:
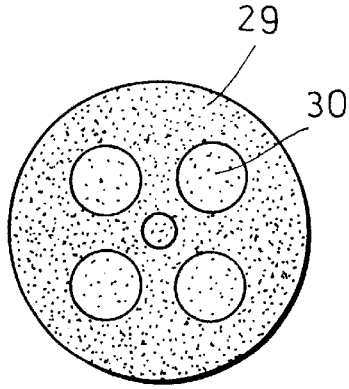

It has further been found to be advantageous to use, for improving the acceleration process of the projectile, a fourth partial charge comprising a metal hydride-water mixture (for example, $AlH_3$ and $H_2O$) which releases hydrogen gas during the chemical reaction of the propellant. The metal hydride-water mixture may be placed in suitable openings in the powder bars as schematically shown in FIGS. 7 and 8 where the powder parts are designated at 29 and the metal hybrid-water mixture is designated at 30.

If, for the third partial charge instead of powder bars 0-hole powder grains are used, within the first partial charge individual powder grains may be omitted to thus obtain, in the longitudinal direction of the propellant, channels which are filled with the metal hydride-water mixture during assembly. In this manner, high packing densities may be obtained.

It will be understood that the above description of the present invention is susceptible to various modifications, changes and adaptations, and the same are intended to be comprehended within the meaning and range of equivalents of the appended claims.

What is claimed is:

1. A propellant system for launching a large-caliber projectile, comprising (a) a propellant including
  (1) a first partial charge adapted to acceleration requirements of the projectile;
  (2) a second partial charge having a higher combustion velocity than that of said first partial charge; and
  (3) a third partial charge having a lower combustion velocity than that of said first partial charge; and (b) an electric energy supply and control device connected to said propellant for igniting said propellant; said electric energy supply and control device including plasma generating means for affecting a combustion behavior of said propellant for obtaining for said first partial charge, after ignition of said propellant, a maximum gas pressure level of always the same magnitude independently from an initial propellant temperature, and for obtaining, for said third partial charge, a conversion such as to prolong the maximum gas pressure level in a predeterminable manner.

2. The propellant system as defined in claim 1, wherein said first partial charge comprises one of hexagonal and rosetta-shaped powder grains having at least one of a 7-hole and 19-hole geometry arranged in a maximum packing density.

3. The propellant system as defined in claim 1, wherein said second partial charge is a bulk powder arranged in a frontal region of said propellant as viewed in a firing direction.

4. The propellant system as defined in claim 1, wherein said third partial charge comprises a plurality of parallel-spaced, symmetrically disposed tubular powder bars each having a longitudinal channel; said electric energy supply and control device including a conductor wire disposed in each said channel.

5. The propellant system as defined in claim 1, wherein said third partial charge comprises a plurality of one of hexagonal and rosetta-shaped, 0-hole powder grains arranged to define a longitudinal channel; said electric energy supply and control device including a conductor wire disposed in said channel.

6. The propellant system as defined in claim 1, wherein said third partial charge is optically transparent.

7. The propellant system as defined in claim 1, wherein said propellant further comprises a fourth partial charge for releasing hydrogen during a conversion of said propellant.

8. The propellant system as defined in claim 7, wherein said fourth partial charge comprises a metal hydride-water mixture.

9. The propellant system as defined in claim 7, wherein said propellant has a longitudinal axis and recesses extending parallel to said longitudinal axis; further wherein said fourth partial charge is disposed in said recesses.

* * * * *